US007384288B2

(12) United States Patent
Sano et al.

(10) Patent No.: US 7,384,288 B2
(45) Date of Patent: Jun. 10, 2008

(54) CONNECTOR FOR PRINTED CIRCUIT BOARDS STACKED ONE ON ANOTHER

(75) Inventors: Koji Sano, Kobe (JP); Ryo Moriwake, Osaka (JP); Toshiaki Matsuno, Amagasaki (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/776,585

(22) Filed: Jul. 12, 2007

(65) Prior Publication Data

US 2008/0026608 A1 Jan. 31, 2008

(30) Foreign Application Priority Data

Jul. 26, 2006 (JP) ..... 2006-202820

(51) Int. Cl.
*H01R 29/00* (2006.01)

(52) U.S. Cl. ..... 439/189; 439/682

(58) Field of Classification Search ..... 439/189, 439/507, 83, 82, 682, 74, 70
See application file for complete search history.

(56) References Cited

U.S. PATENT DOCUMENTS 4,155,612 A * 5/1979 Silverio ..... 439/52
5,145,386 A * 9/1992 Berg et al. ..... 439/83
6,368,128 B1 * 4/2002 Backer et al. ..... 439/189

* cited by examiner

*Primary Examiner*—Phuong Dinh
(74) *Attorney, Agent, or Firm*—Antonelli, Terry, Stout & Kraus, LLP.

(57) ABSTRACT

To provide a connector that enables change in the arrangement of signal connections 'S' and grounding connections 'G', merely by putting short-circuit pins in the housing of the connector, but without needing any change made in the circuit pattern on printed circuit boards that are stacked one on another to be electrically connected one to another.

The connector has a housing (2) and a number of vertical holes (7) pierced in and extending between a top and a bottom of the housing so as to penetrate it, the holes being for insertion of terminal pins (57). A front and rear walls (3, 4) of the housing respectively have horizontal slots (8*a*, 8*b*) arranged to form an upper row and a lower row to receive contacts (20, 21, 22), with each slot extending to intersect the corresponding vertical hole (7) at a right angle. One of the printed boards (40) is connected to the contacts held in the slots, and the terminal pins (57) surface mounted on the other printed circuit board are fitted in the vertical holes (7) so as to be electrically connected to the contacts (20, 21, 22). The connector further has short-circuit pins (30) and canalled apertures (9) that are formed in the front and rear walls (3, 4) each in communication with the two adjacent slots (8*a*, 8*b*), such that each short-circuit pin (30) fitted in the chosen one of the canalled apertures (9) is kept in touch with the two contacts (21, 22) held in the two adjacent slots, thereby establishing electrical engagement of the one contact (21) with the other (22), thus changing arrangement of signal connections 'S' and grounding connections 'G' on the printed circuit board (40).

2 Claims, 20 Drawing Sheets

CONNECTOR FOR PRINTED CIRCUIT BOARDS STACKED ONE ON ANOTHER

FIELD OF THE INVENTION

The present invention relates to a connector, particularly of the multi-polar type, for establishing electric interconnection between printed circuit boards stacked vis-à-vis one on another in parallel, wherein a variety of electronic devices are surface mounted on each circuit board.

BACKGROUND ART

One of the prior art multi-polar connectors 61 for interconnecting printed circuit boards is shown in FIGS. 22 to 24. It comprises a depressed connector housing 62 of a rectangular parallelepiped shape. A number of vertical holes 67 pierced in and extending between the top 65 and bottom 66 of the connector housing are for insertion of terminal pins (not shown). A front wall 63 and a rear wall 64 respectively have horizontal slots 68 pierced therein. Each of those slots 68 arranged to form an upper row and a lower row does extend to intersect the corresponding one of vertical holes 67 at a right angle. Upper contacts 71 are inserted in the upper row of slots 68, with lower contacts 72 being for insertion into the lower row of these slots. Each contact 71 and 72 has a pin receiving portion (not shown) that engages with the pin inserted in the slot. Each contact further has a body portion extending rearwards from the pin receiving portion. A rear end region of the body portion is bent down and then rearwards to form a lead portion 73. One of the printed boards 75 has a circuit pattern 76 that is to be soldered to such lead portions 73 of the contacts. The other printed circuit boards not shown but mating with the one printed board does have terminal pins that are surface mounted to fit in the vertical holes 67. Said pins from the mating printed board thus engage with pin receiving portions and establish electric connection to the upper or lower contacts 71 and 72.

In the connector 61 described above, its upper and lower contacts 71 and 72 correspond to the respective vertical holes 67 and electrically engage with the circuit pattern 76 of printed board 75. Thus, a number of signal connections as well as and a number of grounding connections are provided for this circuit board. In FIG. 23, such signal connections are indicated by the symbol 'S', with grounding connections being indicated by 'G'. Each signal connection 'S' is surrounded by several grounding connections 'G' so that noise is eliminated from or diminished in signal transmission.

In a case of using such a connector 61 to construct the electric circuit for a hard disc drive or the like device, it has to match any elevated speeds of signal transmission. In detail, for the purpose of eliminating noise, arrangement of the signal connections 'S' and grounding connections 'G' will often be changed in the circuit pattern on the printed board 75.

The contacts 71 and 72 in the prior art connector 61 are all discrete members operating independently of each other. Therefore, another printed board 77 of a different circuit pattern 78 should be employed as shown in FIGS. 25 to 27. Such an alternative circuit board is indispensable to change the relative positional relationship between those signal and grounding connections 'S' and 'G'.

DISCLOSURE OF THE INVENTION

Objects to be Achieved

An object of the present invention made in view of the drawback inherent in the prior art connectors noted above is to provide a novel connector such that mere insertion of short-circuit pins into a connector housing will suffice well to change the arrangement of signal and grounding connections 'S' and 'G', without needing any alternative printed board of a different circuit pattern.

Solutions

In order to achieve the object, the invention proposes a connector adapted for establishing electric interconnection between printed circuit boards stacked vis-à-vis one on another in parallel, the connector comprising a depressed connector housing of a rectangular parallelepiped shape. The connector further comprises a number of vertical holes pierced in and extending between a top and a bottom of the connector housing so as to penetrate it, the holes being for insertion of terminal pins, and a front wall and a rear wall of the housing respectively have horizontal slots pierced therein to receive contacts. Each of the slots that are arranged to form an upper row and a lower row does extend to intersect the corresponding one of vertical holes at a right angle. Each contact has a pin receiving portion that engages with the terminal pin inserted in the slot. Each contact further has a body portion extending rearwards from the pin receiving portion. A rear end region of the body portion is bent down and then rearwards to form a lead portion. One of the printed boards has a circuit pattern that is to be soldered to such lead portions of the contacts, and the other printed circuit board mating with the one printed board has the terminal pins surface mounted to fit in the vertical holes. The terminal pins from the mating printed board thus electrically engage with the pin receiving portions. Characteristically, the connector of the present invention further comprises short-circuit pins as well as canalled apertures that are formed in the front and rear walls each in communication with the two adjacent slots. Each short-circuit pin fitted in the chosen one of the canalled apertures will be kept in touch with the two contacts held in the two adjacent slots, thereby establishing electrical engagement of one of the two contacts with the other so as to change arrangement of signal connections 'S' and grounding connections 'G' on one of the printed circuit boards.

In more detail, each canalled aperture for insertion of the short-circuit pin is a narrow vertical opening that has at its inner end a recess. Each short-circuit pin made by the punching of a conductive metal plate has an end lug projected from the forward end of a body of the pin. A pair of resilient tongues protrude rearwardly and sideways from the upper and lower sides of the pin body, and a picking ear protrudes from the rearward end of said pin body. With the short-circuit pin being put into the canalled aperture, the end lug of this pin will fit in the recess so as to secure it in position. The pair of resilient tongues will be forced into pressed touch with the two contacts held in the two adjacent slots, thus bringing these two contacts into mutual electric communication.

Advantages Afforded Herein

It will be apparent from the foregoing that the short-circuit pins may simply be fitted in any selected group of the canalled apertures formed in the front and rear walls of the connector housing. Now, circuit pattern on the printed circuit boards need no longer be altered often and intricately when changing the arrangement of signal connections 'S' and grounding connections 'G'. The electric circuit in and around this connector can be changed readily, without expensively replacing the existing printed circuit board with any alternative one.

BRIEF DESCRIPTION OF THE DRAWINGS

FIG. 18(*b*) is a fragmentary perspective view of the short-circuit pin, shown in its state after insertion;

FIG. 19(*b*) is a fragmentary cross section of the short-circuit pin, shown in a state after insertion;

The Preferred Embodiments

Figure 1:
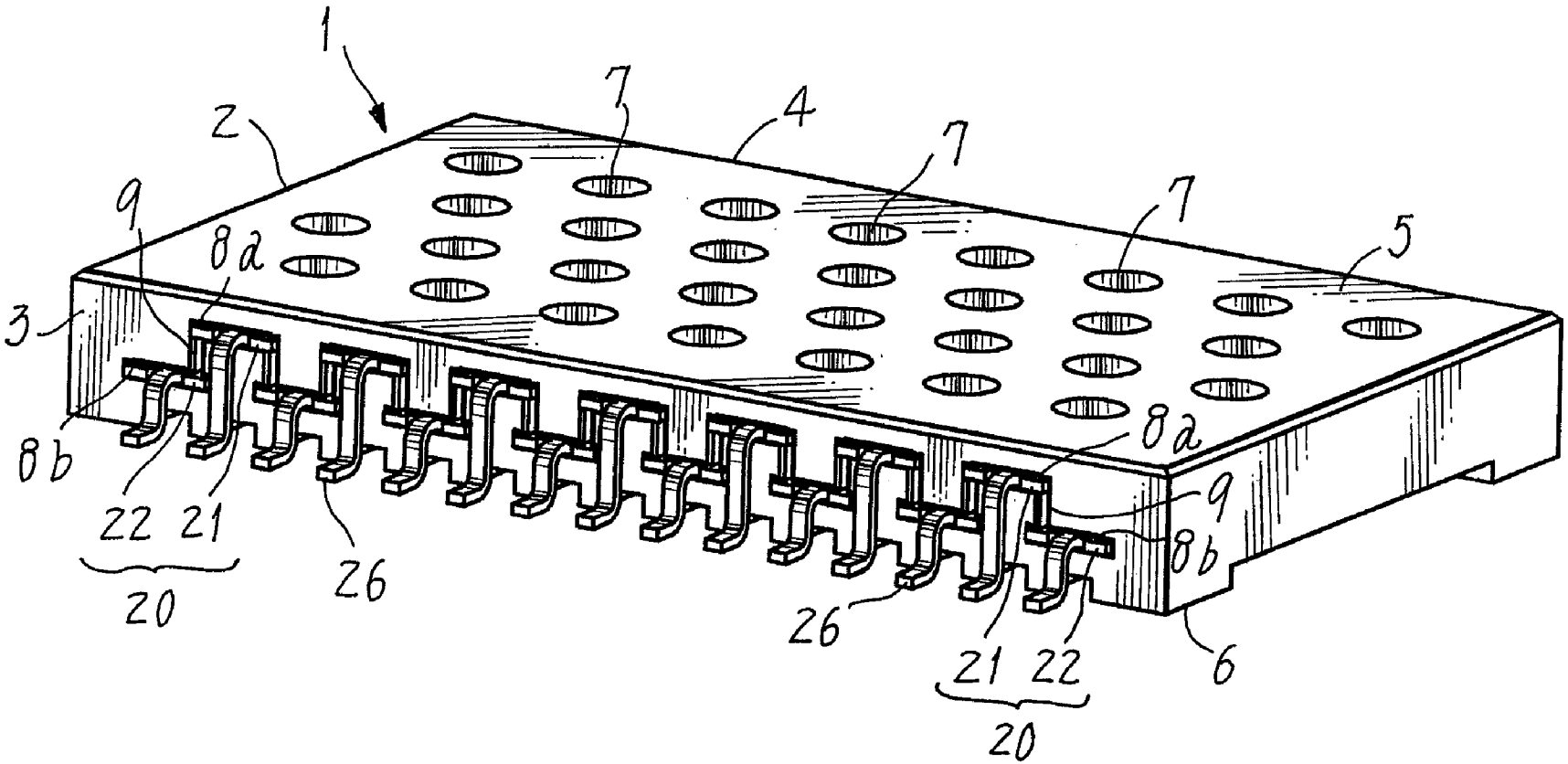
FIG. 1 Perspective view of a connector which the present invention provides.
Figure 2:
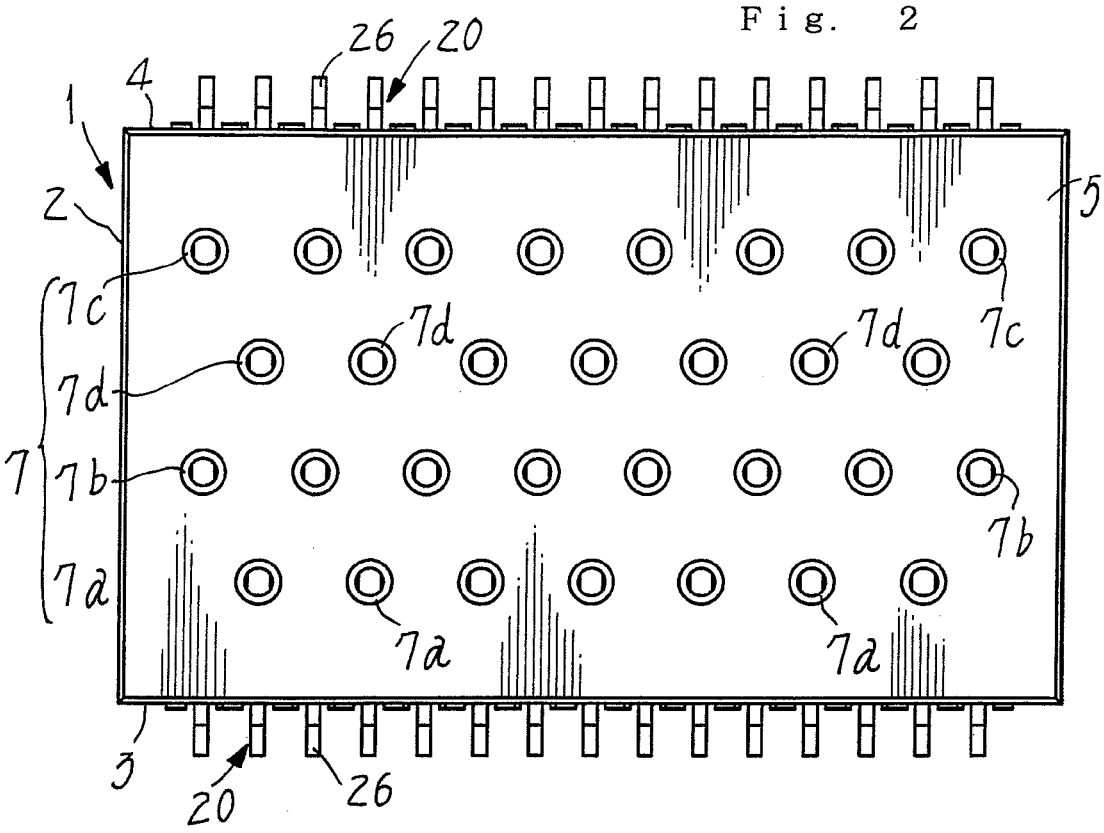
FIG. 2 is a plan view of the connector.
Figure 3:
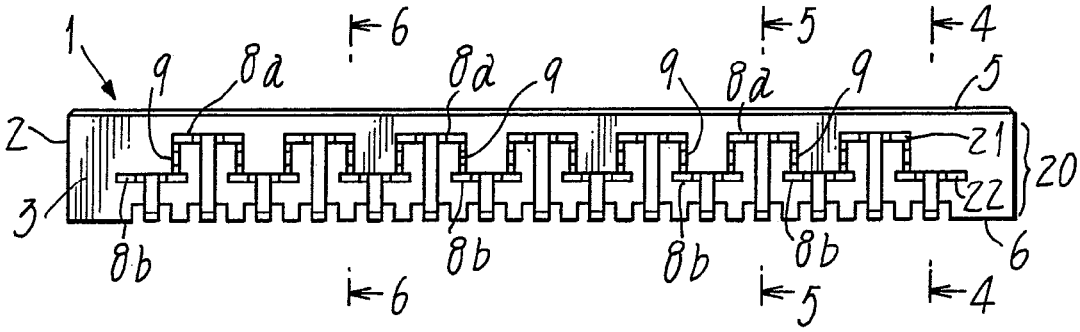
FIG. 3 is a front elevation of the connector.
Figure 4:
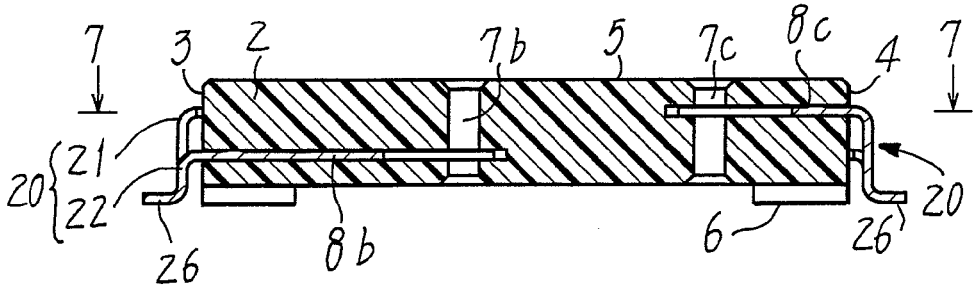
FIG. 4 is a cross section taken along the line 4-4 in FIG. 3.
Figure 5:
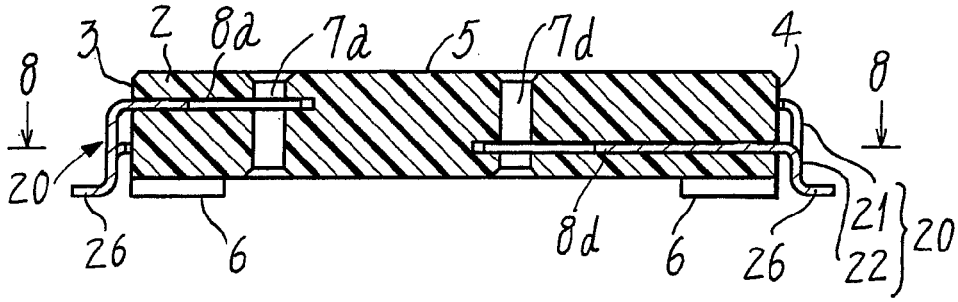
FIG. 5 is a cross section taken along the line 5-5 in FIG. 3.

Now some embodiments of the present invention will be described referring to the accompanying drawings.

FIGS. 1 to 7 are schemes showing a connector 1 provided herein. This connector 1 is generally composed of a connector housing 2 of a depressed parallelepiped shape and a number of contacts 20. These contacts respectively inserted through a front wall 3 and a rear wall 4 of the housing 2 are secured in position relative thereto.

The connector housing 2 is made of a Nylon (trademark) or the like insulating resin to have a depressed parallelepiped configuration. A number of vertical holes 7 penetrating the housing from its top 5 to its bottom 6 are for insertion of terminal pins (detailed below). As clearly shown in FIG. 2, those holes 7 are arranged zigzag to form four rows, two rows 7*a* and 7*b* of them adjacent to the front wall 3 of housing 2 are for connection with the contacts 20 that are disposed in and through this front wall. The remaining two rows 7*c* and 7*d* of the holes 7 adjacent to the rear wall 4 of housing 2 are for connection with the further contacts 20 that are disposed in and through this rear wall.

Figure 6:
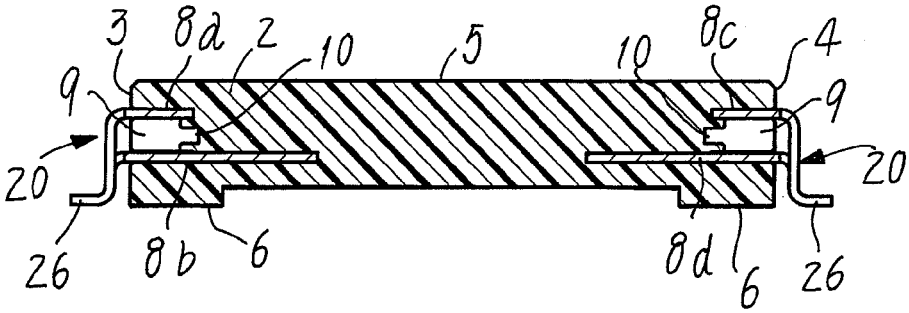
FIG. 6 is a cross section taken along the line 6-6 in FIG. 3.
Figure 7:
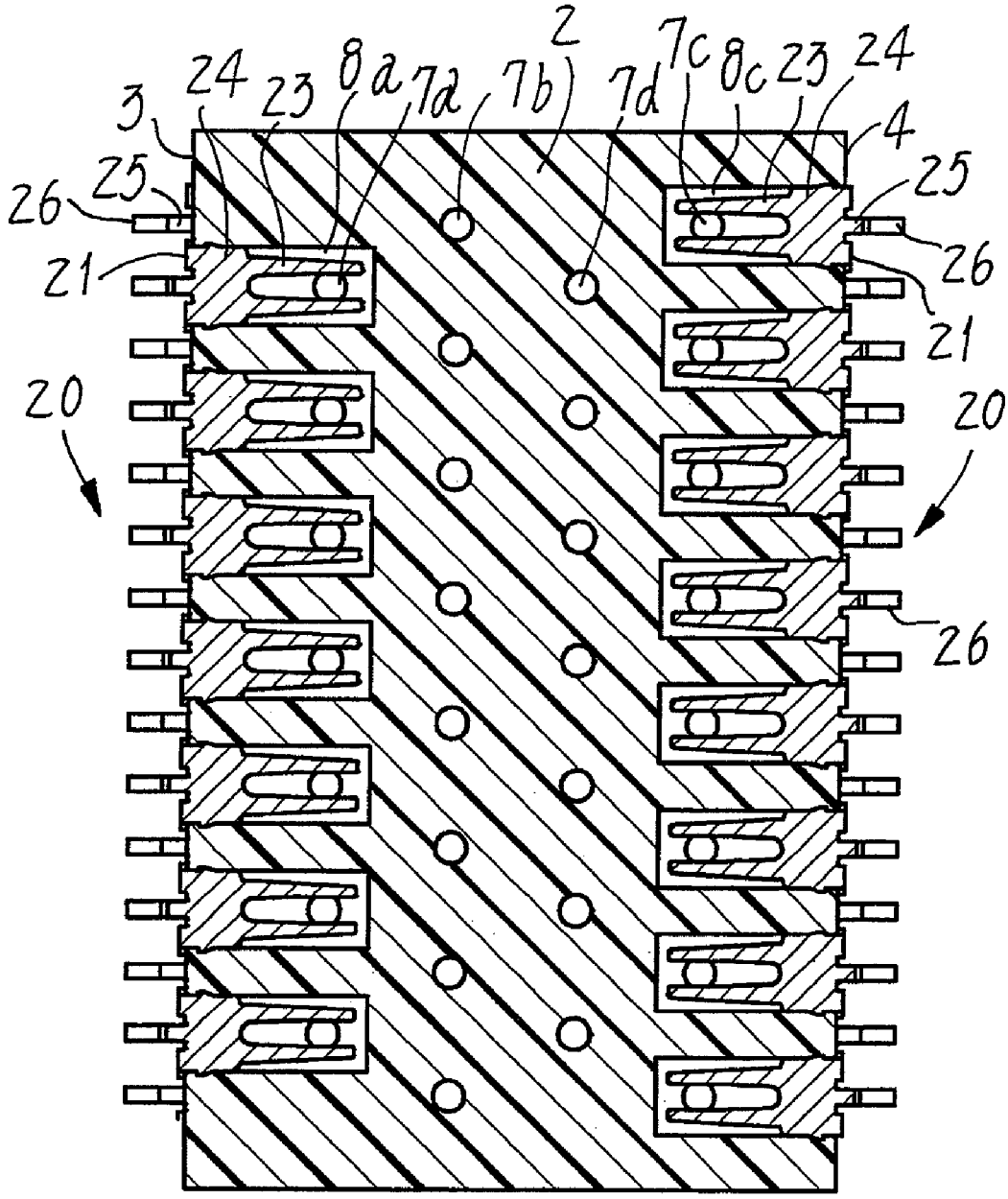
FIG. 7 is a cross section taken along the line 7-7 in FIG. 4.
Figure 8:
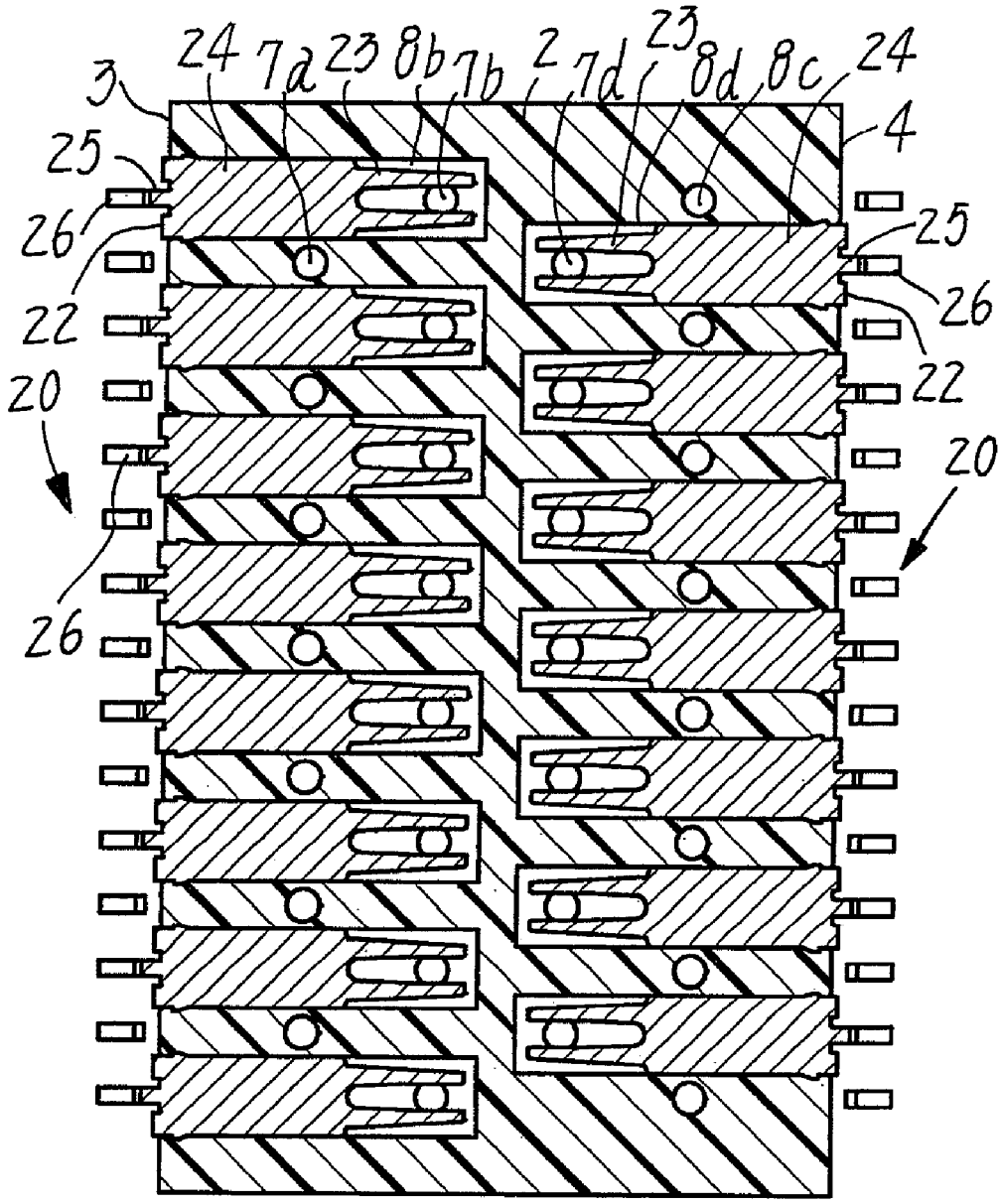
FIG. 8 is a cross section taken along the line 8-8 in FIG. 5.

As seen from FIGS. 3 to 8, slots 8*a* and 8*b* receive and firmly hold the contacts (detailed below) that extend inwards from the front wall 3 of housing 2, such that those slots form two rows, upper and lower. Further slots 8*c* and 8*d* receive and firmly hold the other contacts 20 extending inwards from the rear wall 4 of housing 2, such that those slots also form two rows, upper and lower. Corresponding to width of each contact as detailed below, each slot 8*a* to 8*d* is an opening of a depressed shape elongated sideways. One end of each upper slot 8*a* (8*c*) is in alignment with one end of the adjacent lower slot 8*b* (8*d*) facing the former one 8*a* (8*c*). The upper slots 8*a* correspond to the vertical holes 7*a* near the front wall 3 and extend perpendicularly to these holes. The lower slots 8*b* correspond to the other vertical holes 7*b* and extend perpendicularly thereto. Likewise, the upper slots 8*c* correspond to further vertical holes 7*c* near the rear wall 4 and extend perpendicularly to these holes. The lower slots 8*d* correspond to still further vertical holes 7*d* and extend perpendicularly thereto. Canalled apertures 9 formed in and extending inwardly from the front or rear wall 3 and 4 will serve to bring one end of each upper slot 8*a* (8*c*) into communication with one end of the adjacent lower slot 8*b* (8*d*). A short-circuit pin will be fitted in each canalled aperture 9 that is a narrow depressed opening extending up and down. As seen in FIG. 6, each canalled aperture 9 has an upper end in communication with the end of one upper slot 8*a* (8*c*), and also has a lower end in communication with the end of one lower slot 8*b* (8*d*). A narrow recess 10 formed in the innermost region of each canalled aperture 9 is for engagement with the short-circuit pin fitted therein.

Figure 9:
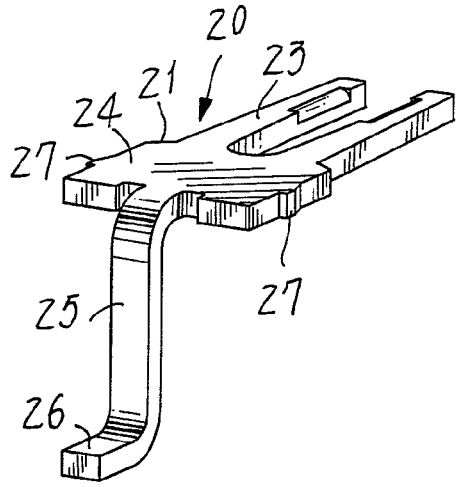
FIG. 9 is a perspective view of one of upper contacts.
Figure 10:
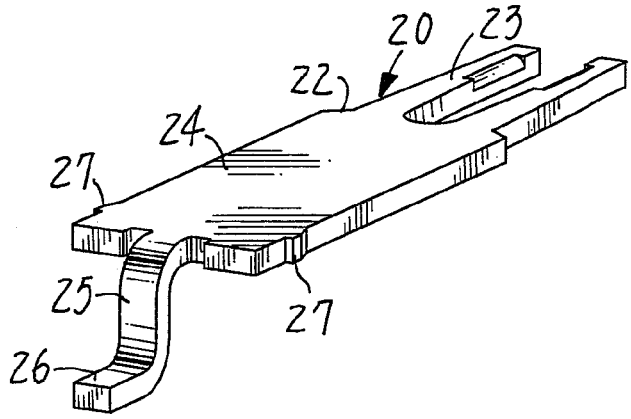
FIG. 10 is a perspective view of one of lower contacts.

The contacts 20 may be made each from a raw piece that is prepared by the punching of a conductive metal plate such as a phosphor bronze plate, the raw piece being then bent to give such shapes as shown in FIG. 9 or 10. Those contacts 20 belong either to a group of upper contacts 21 to be fitted in upper slots 8*a* (8*c*), or to another group of lower contacts 22 to be fitted in lower slots 8*b* (8*d*).

Each upper contact 21 has a pin receiving portion 23 U-shaped and facing the vertical hole 7*a* (7*c*), and a body portion 24 (somewhat shorter than that of each lower contact) that extends rearwards from the pin receiving portion. A rear end region of the body portion 24 is bent down to form a tail 25 disposed in parallel with the front or rear wall 3 and 4. This tail 25 is then bent rearwards to form a lead portion 26 that extend generally in flush with the bottom 6 of housing 2, such that this portion will be soldered to a circuit pattern 41 of one of printed circuit boards 40 as will be detailed below. The body portion 24 is of a transverse width generally equal to that of the upper slot 8*a* (8*c*), and latching protrusions 27 are formed on the opposite sides of body portion 24. With the upper contact 21 being inserted into the upper slot 8*a* (8*c*) of housing 2, such latching protrusions 27 will be forced into an interference-fit state strongly catching the inner wall surfaces of said upper slot, thus fixing this contact 21 in the housing.

Each of the lower contacts 22 generally similar to the upper contacts 21 has however a longer body portion 24 so that the pin receiving U-shaped portion 23 comes into alignment with vertical hole 7*b* (7*d*). In addition, a tail 25 of the lower contact 22 is somewhat shorter than that of each upper contact 21.

Figure 11:
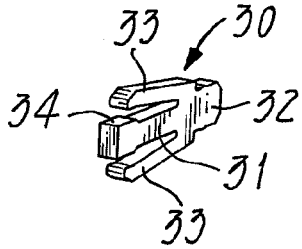
FIG. 11 is a perspective view of a short-circuit pin.

Similarly to the contacts 20, short-circuit pins 30 for insertion into the canalled apertures 9 of the housing 2 may be made by the punching of a conductive, for example phosphor bronze plate, as will be seen from FIG. 11. A lug 32 protruding from the forward end of the body 31 of short-circuit pin 30 is for engagement with the recess 10 mentioned above. A pair of resilient tongues 33 protrude obliquely from the upper and lower sides of the pin body 31, in opposite and backward sideways directions. A picking ear 34 is formed integral with the rearward end of said pin body 31*a*.

Figure 12:
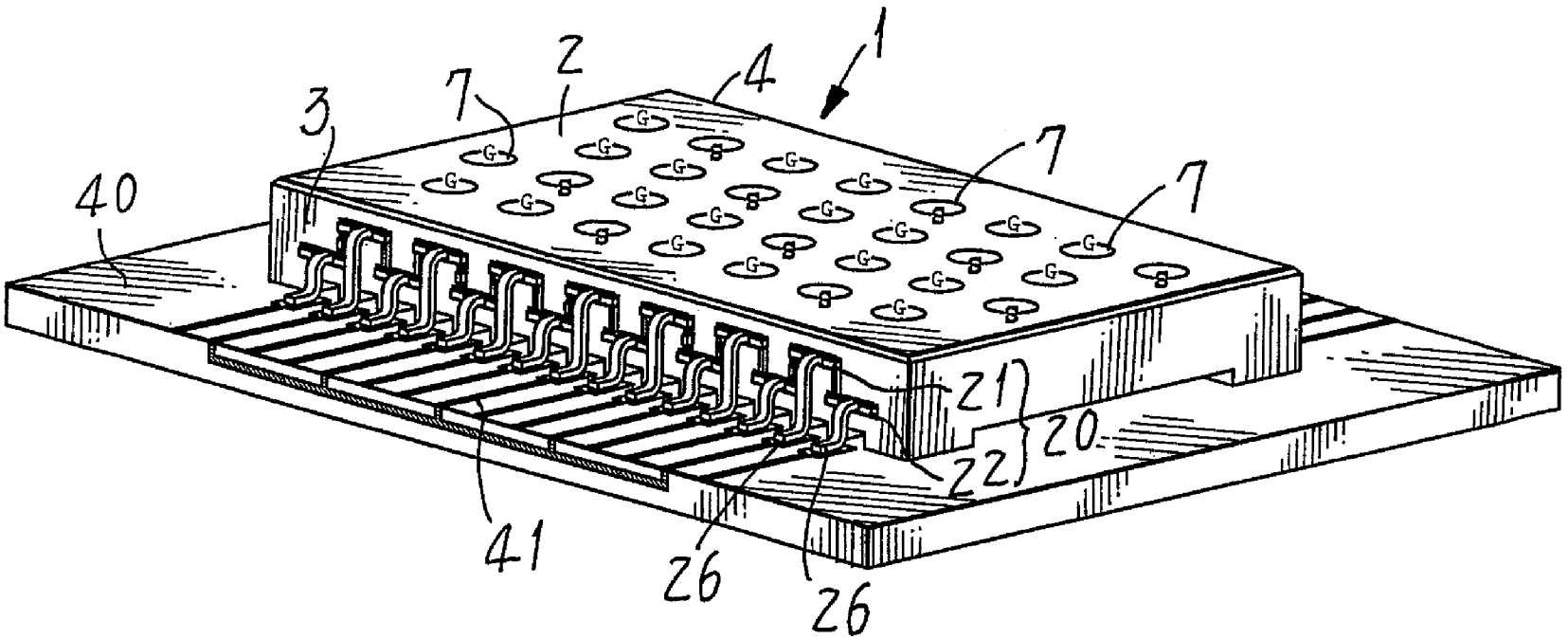
FIG. 12 is a perspective view of the subject connector of the invention, shown in its state as surface mounted on a printed circuit board.

The connector 1 of the structure described above will be surface mounted on one of the printed circuit boards 40 to thereby take a position as illustrated in FIG. 12. The lead portions 26 of upper contacts 21 as well as those 26 of lower contacts 22 alternate one with another to form a single row, so that they are soldered to the circuit pattern 41 to establish an electric connection. The upper contacts 21 and lower contacts 22 corresponding to the respective vertical holes 7 are connected to the circuit pattern 41 on said board 40. Signal connections 'S' and grounding connections 'G' are thus arranged similarly to the case of using prior art connectors.

Figure 13:
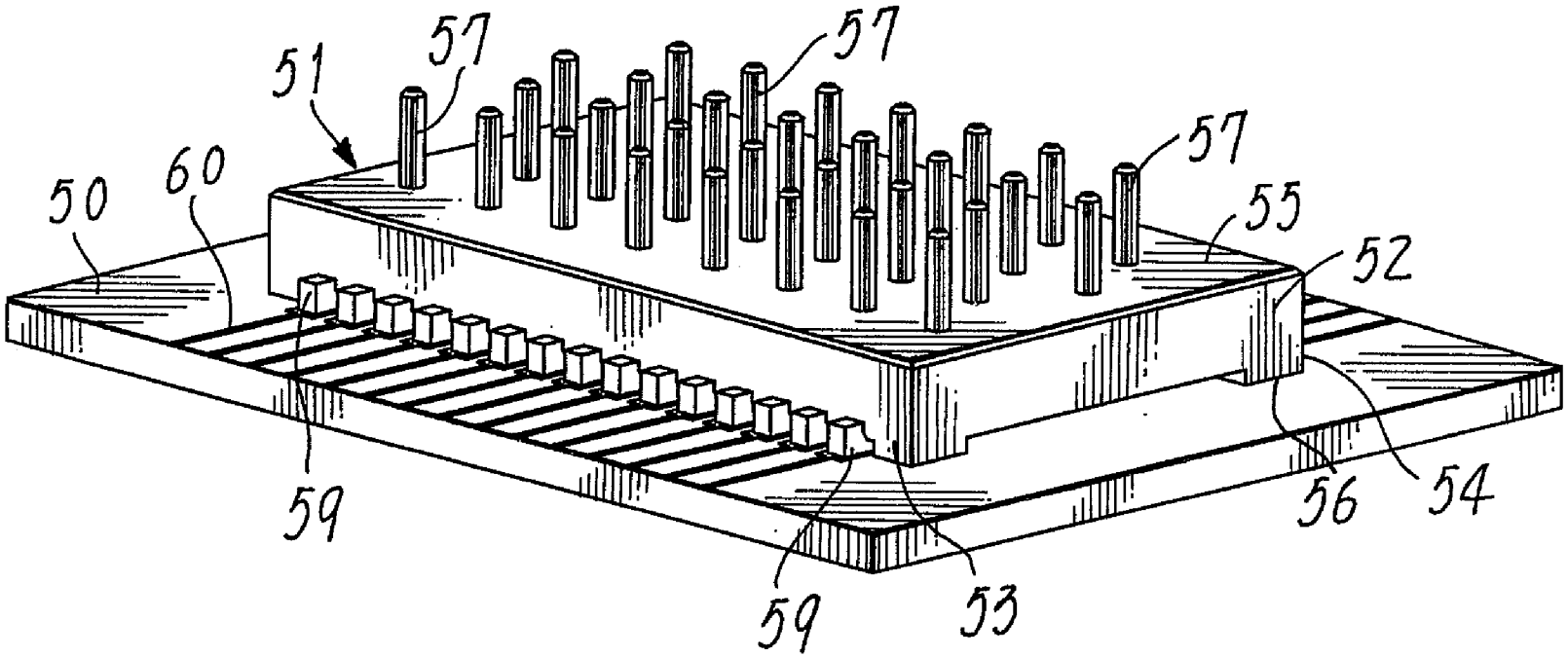
FIG. 13 is a perspective view of a mating connector that is surface mounted on another printed circuit board.
Figure 16:
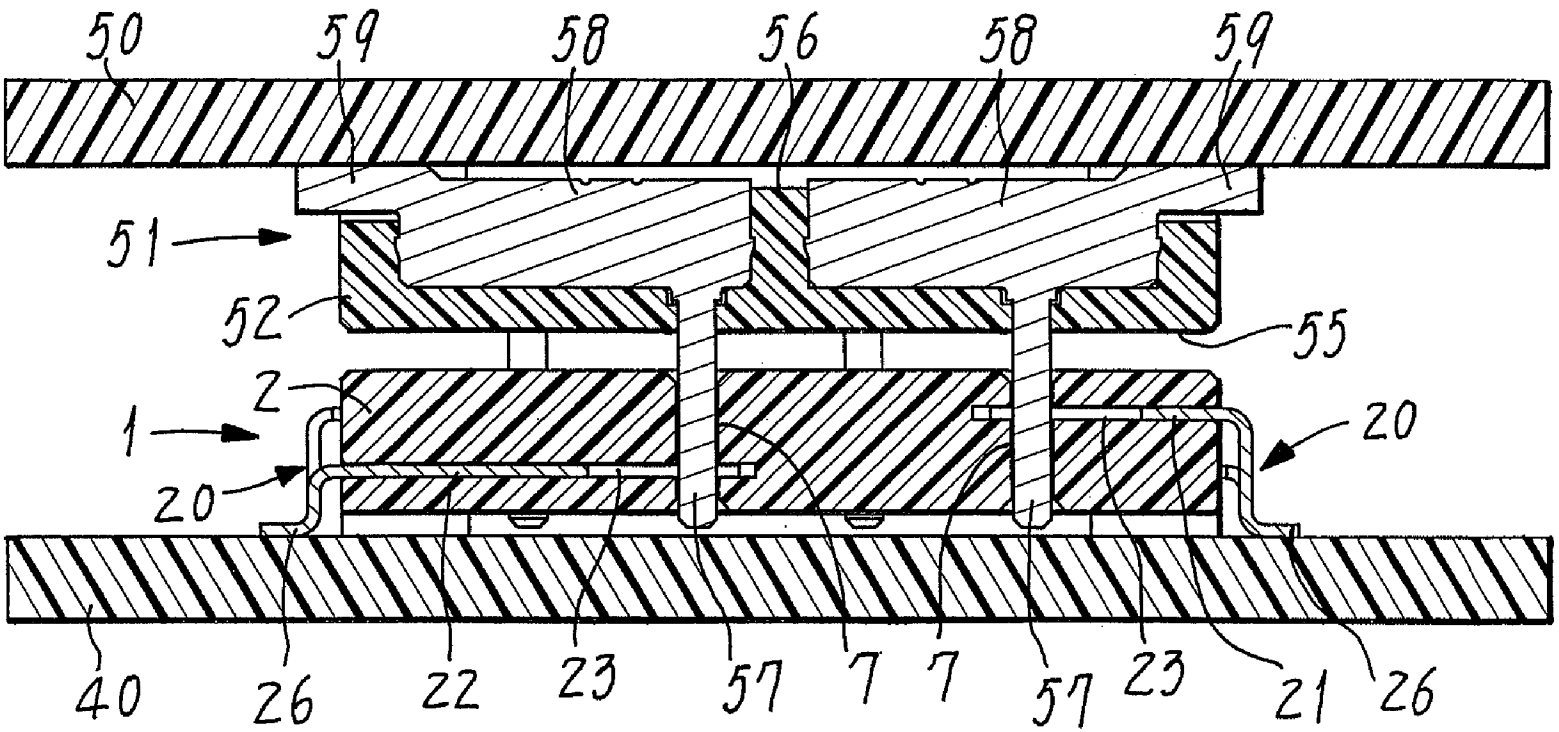
FIG. 16 is an enlarged cross section taken along the line 16-16 in FIG. 15.
Figure 17:
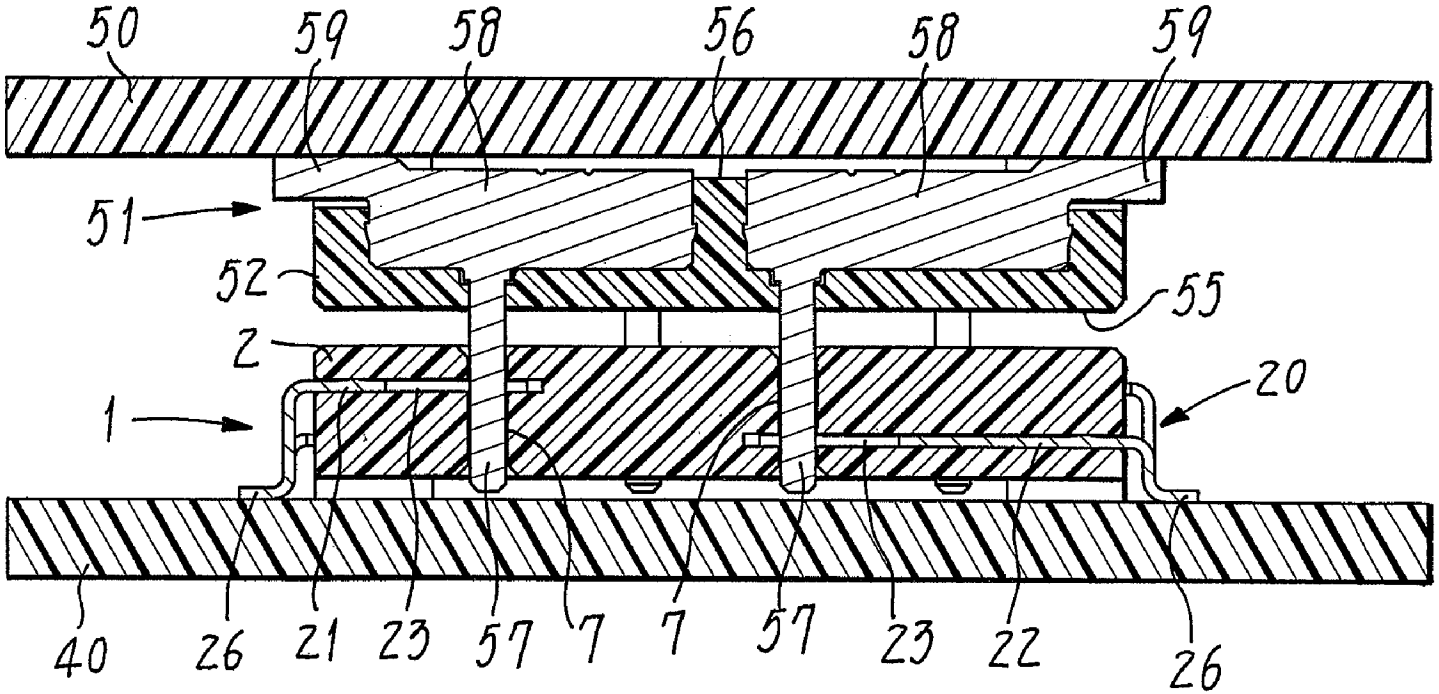
FIG. 17 is an enlarged cross section taken along the line 17-17 in FIG. 15.

The mating connector 51 will be surface mounted on another printed circuit board 50 in a fashion as shown in FIG. 13. Its connector housing 52 is likewise a depressed parallelepiped formed from a Nylon or the like insulating resin similarly to the housing 2 mentioned above. A number of terminal pins 57 constituting the mating connector and fixed in its housing 52 do protrude up from a top 55 thereof As shown in FIGS. 16 and 17, each terminal pin 57 is formed integral with a planar body 58 that is inserted through a bottom 56 of the housing 52. Those terminal pins 57 protrude up from the top 55 of this housing so as to form four rows in a zigzag pattern corresponding to the vertical holes 7 of the first mentioned connector housing 2. Each planar body 58 has a lead portion 59 protruding sideways from a bottom end of this body. These lead portions 59 extend sideways from a front wall 53 or rear wall 54 to form a single row that will be soldered to a circuit pattern 60 of the printed board 50, thus establishing an electric connection.

Figure 14:
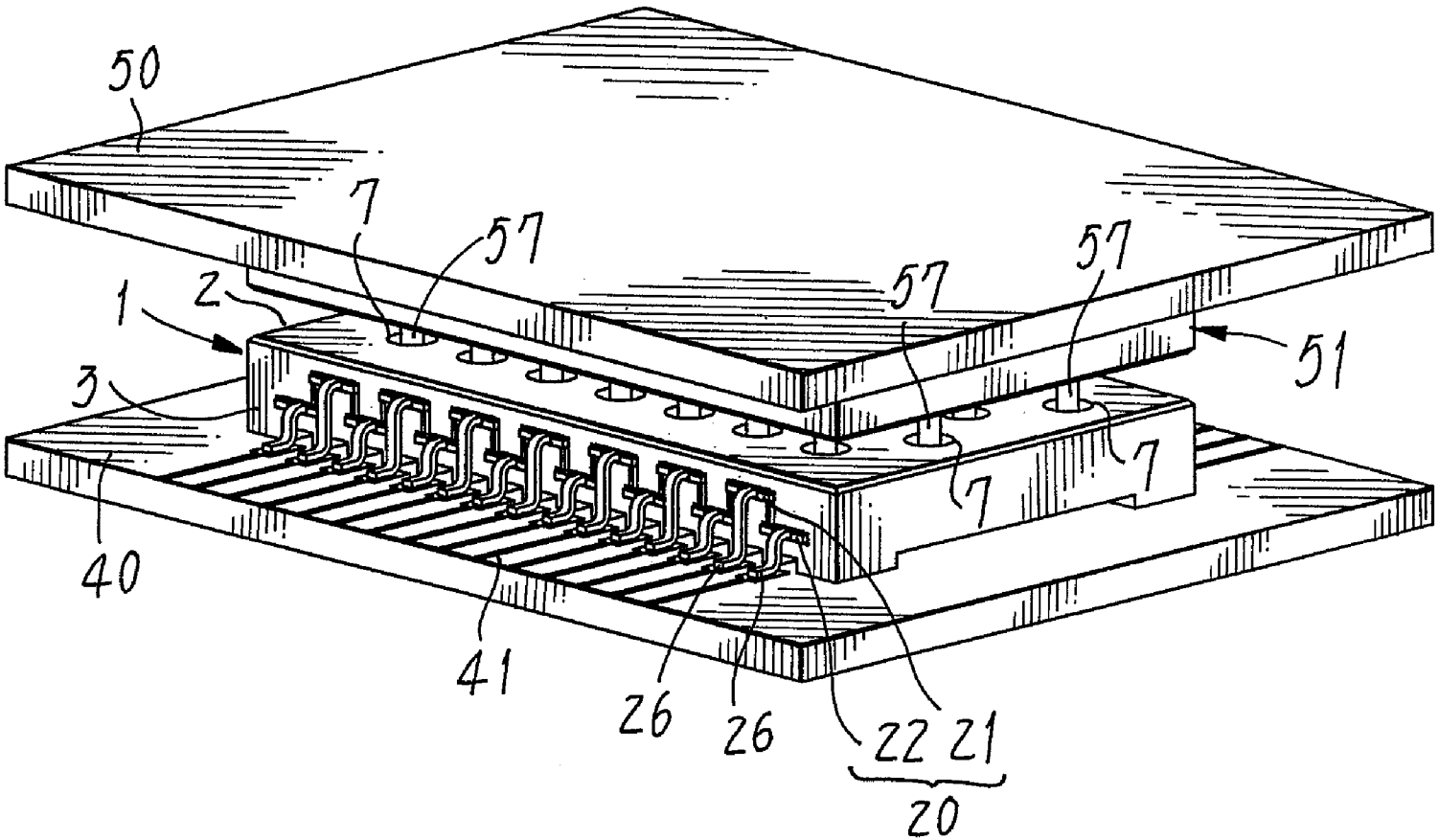
FIG. 14 is a perspective view of the subject connector electrically coupled with the mating connector.
Figure 15:
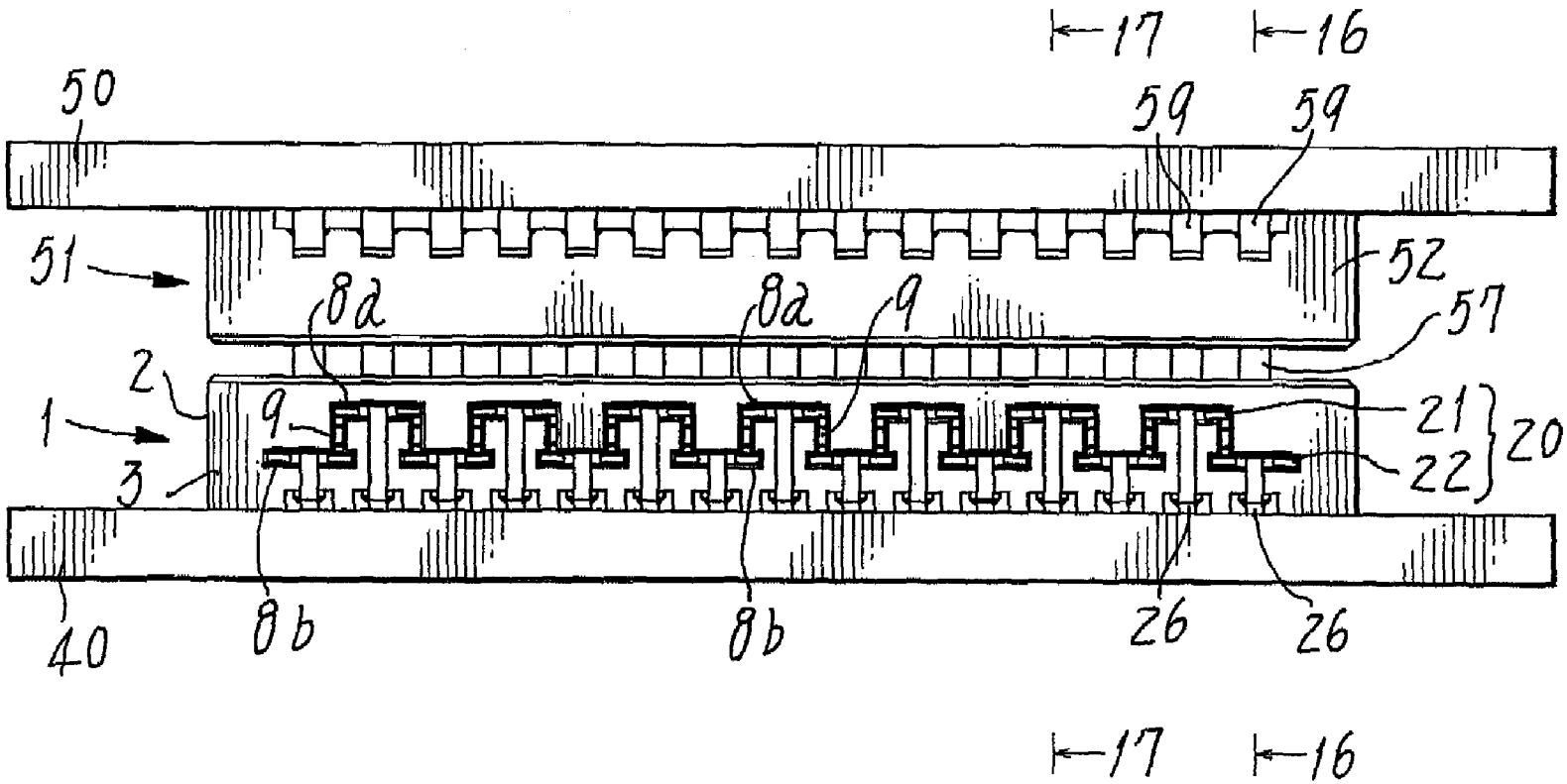
FIG. 15 is a front elevation of the subject connector electrically coupled with the mating connector.

As will be seen from FIGS. 14 and 15, terminal pins 57 disposed in the printed circuit board 50 will be inserted into the corresponding holes 7 of a connector 1 surface mounted on the other printed board 40. Those terminal pins are thus brought into engagement with and electric connection to the respective pin receiving portions of respective upper contacts 21 or lower contacts 22. In this way, the printed board 40 in its entirety is electrically connected to the mating circuit board 50 stacked on and facing the former board 40.

Figure 18:
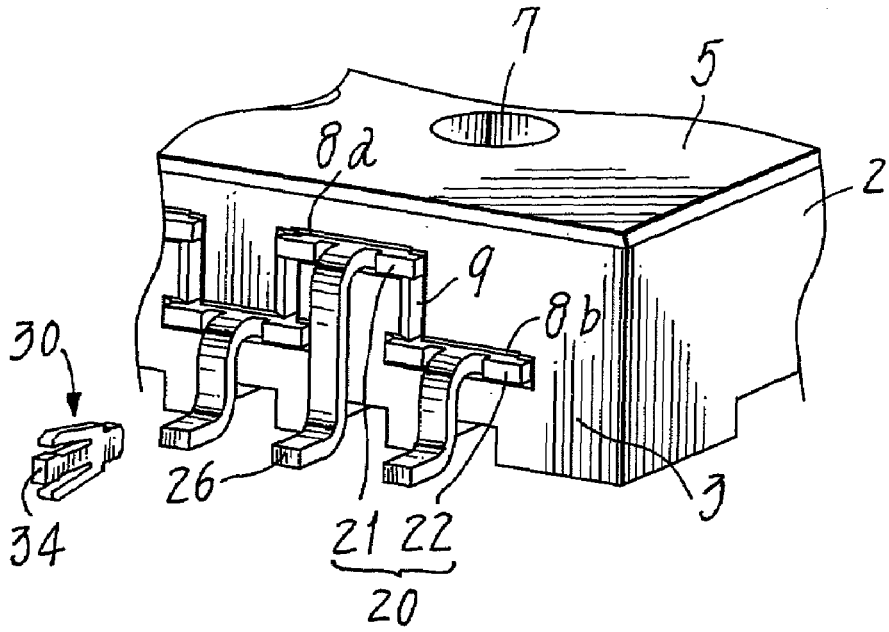
FIG. 18(*a*) is a fragmentary perspective view of a short-circuit pin as one of the principal parts of the subject connector, shown in its state before insertion.
Figure 18:
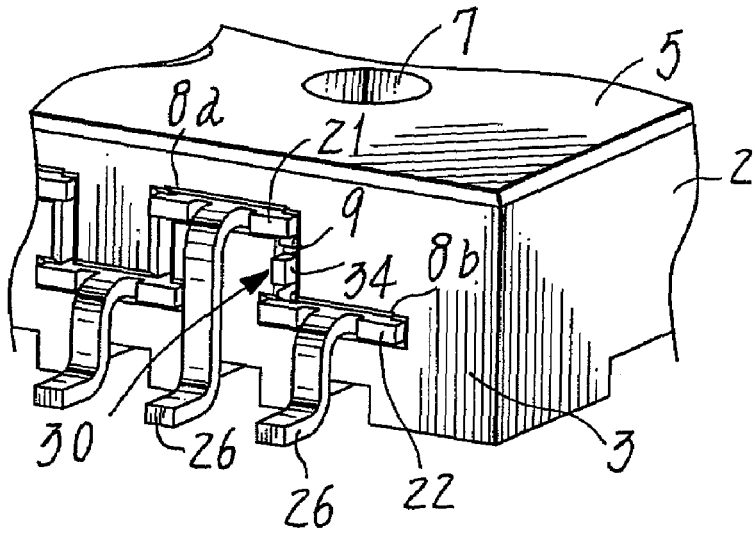
Figure 19:
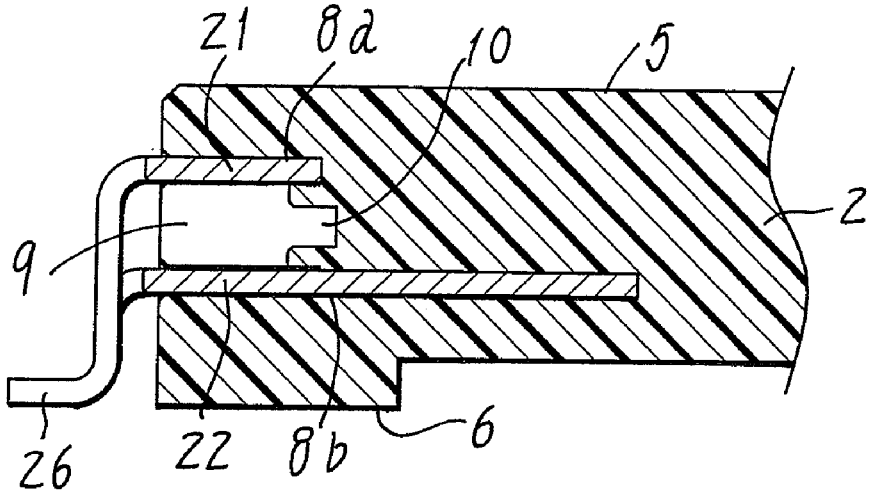
FIG. 19(*a*) is a fragmentary cross section of the short-circuit pin as one of the principal parts of the subject connector, shown in a state before insertion.
Figure 19:
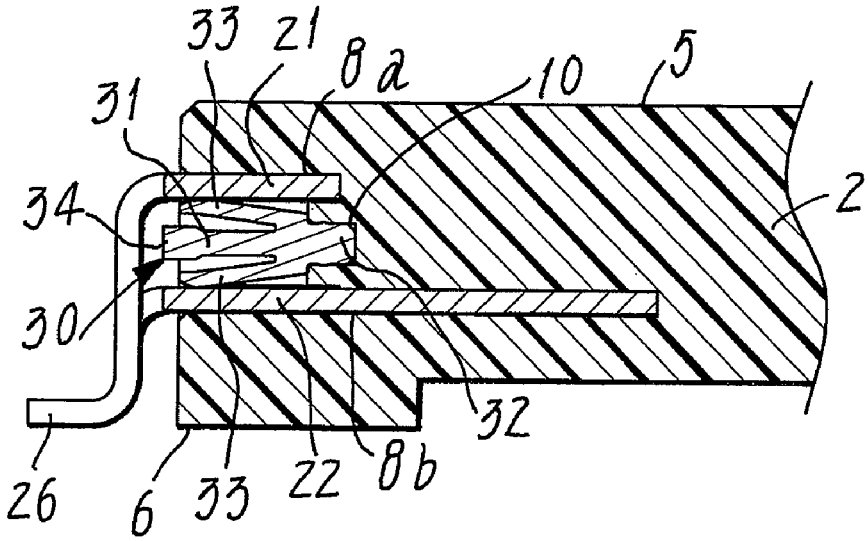
Figure 20:
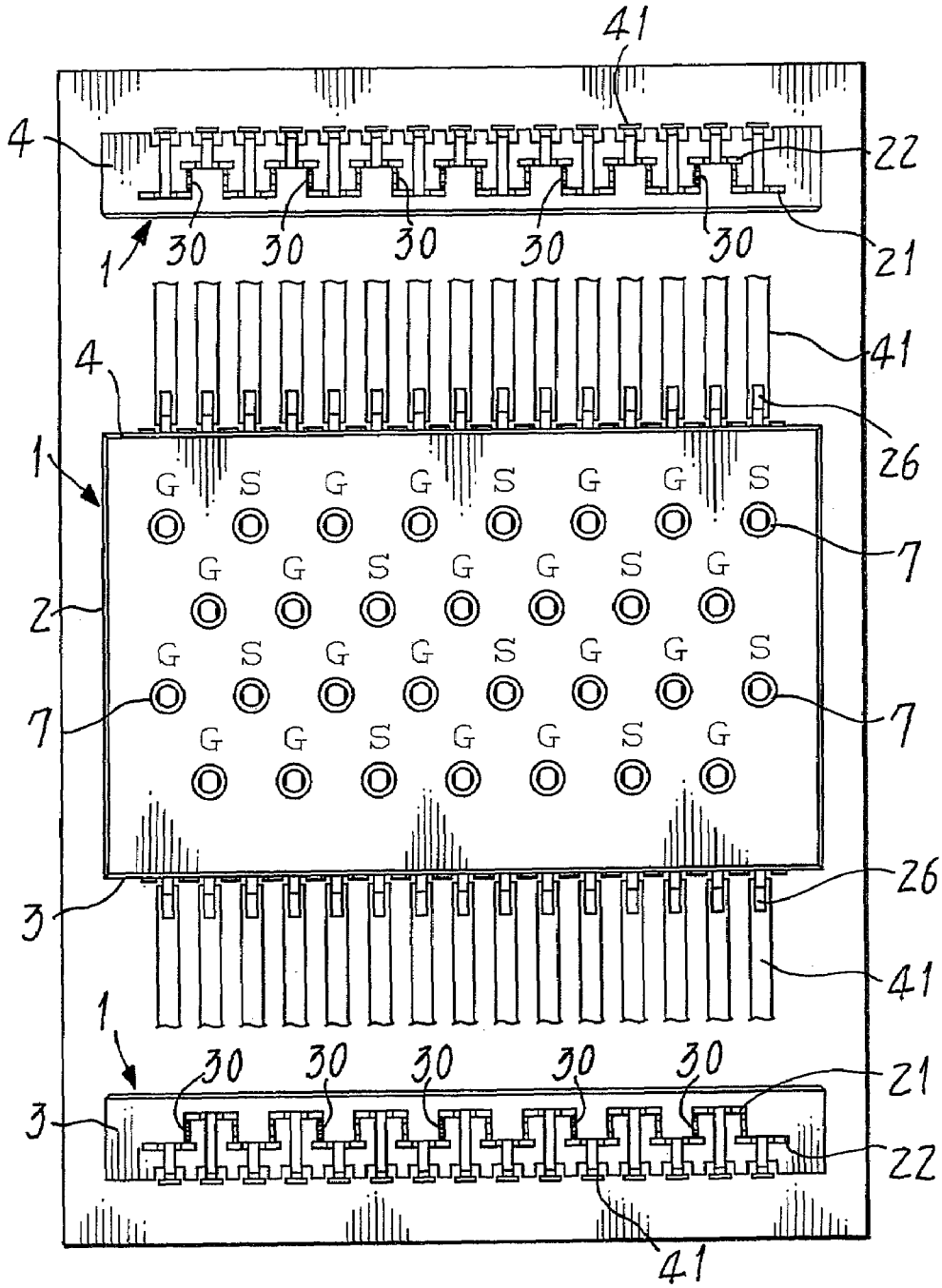
FIG. 20 is a schematic view of a mode of the arrangement of signal connections 'S' and grounding connections 'G', which the connector affords.
Figure 21:
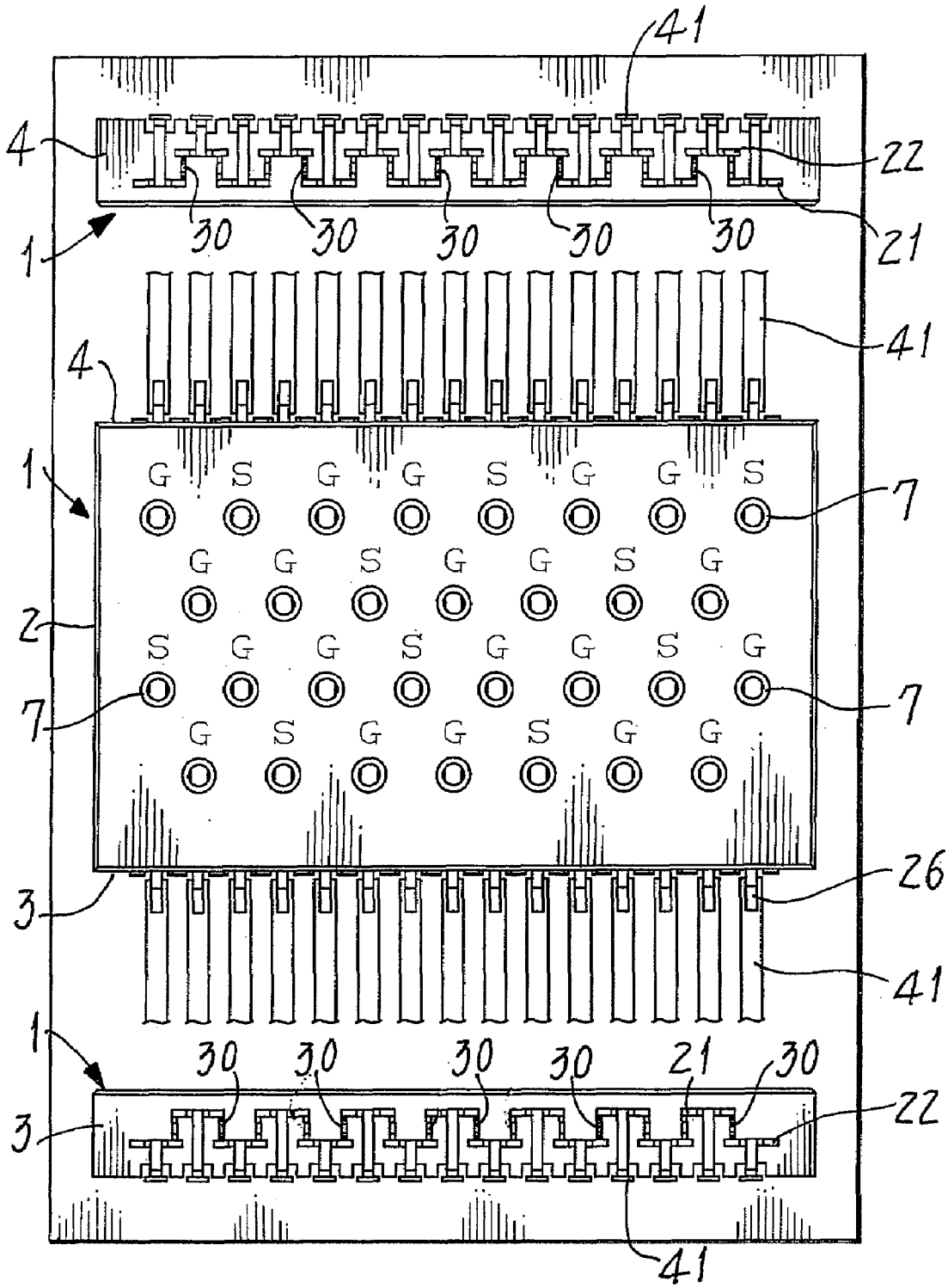
FIG. 21 is a schematic view of another mode of the arrangement of signal connections 'S' and grounding connections 'G'.
Figure 22:
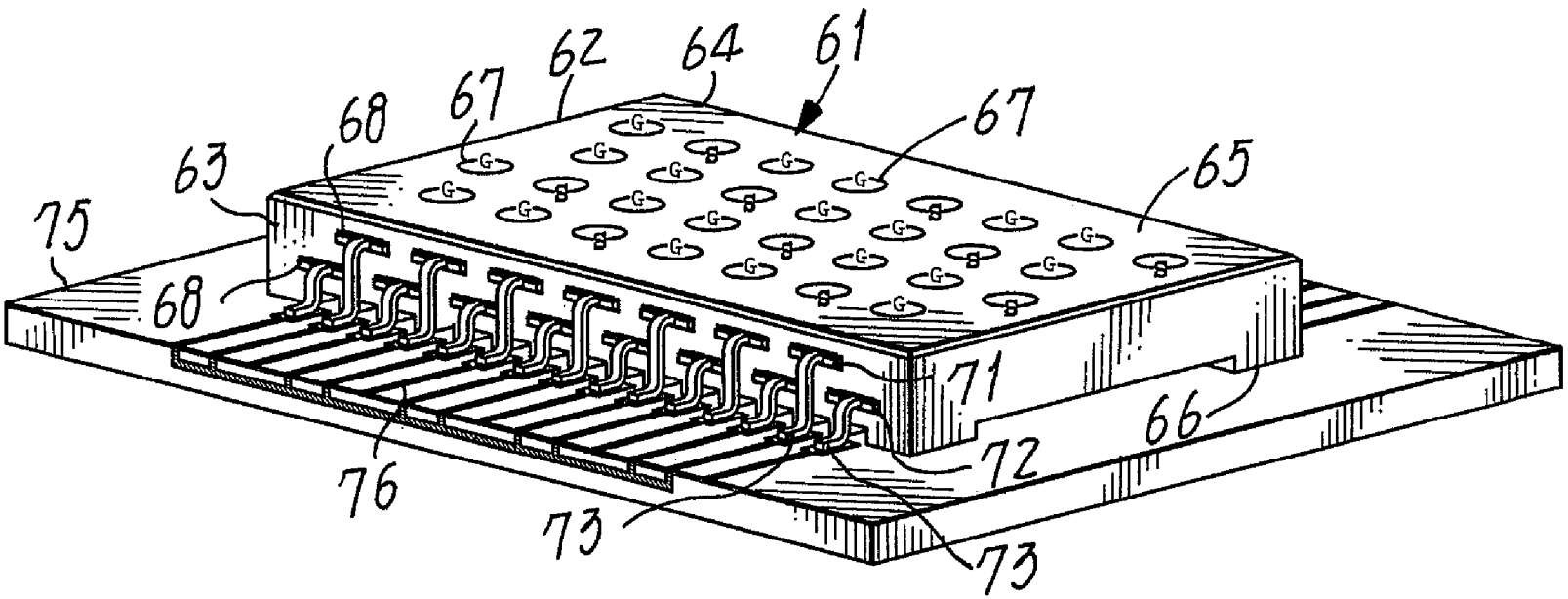
Fig. 22 Prior Art
FIG. 22 is a perspective view of the prior art connector that is surface mounted on a printed circuit board.
Figure 23:
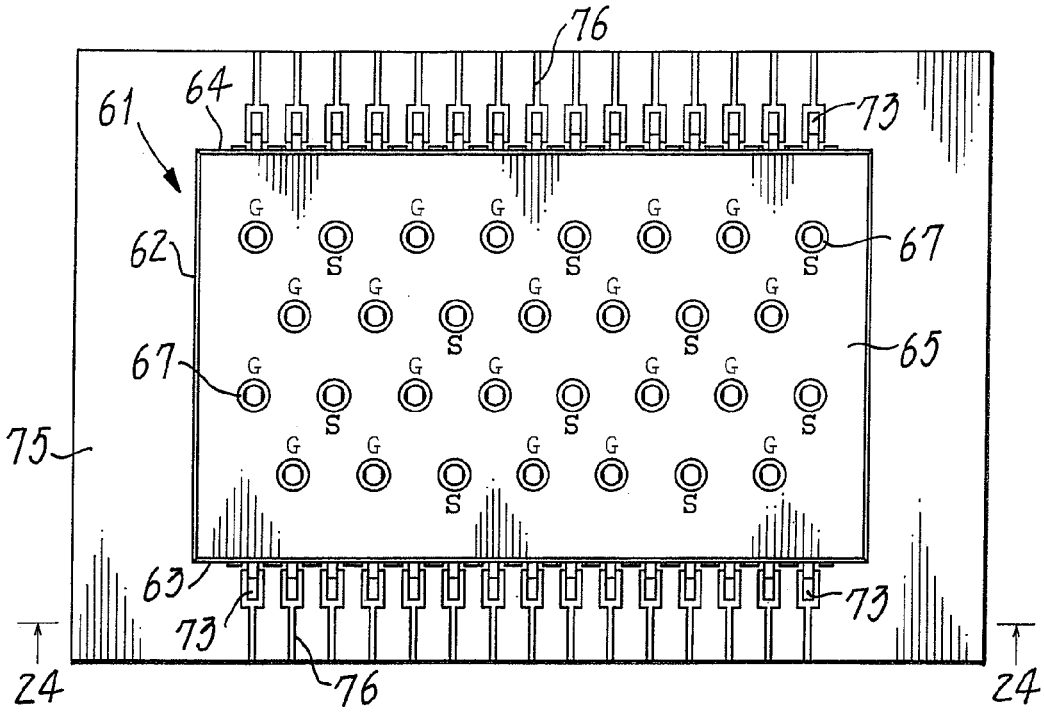
Fig. 23 Prior Art
FIG. 23 is a plan view of the prior art connector.
Figure 24:
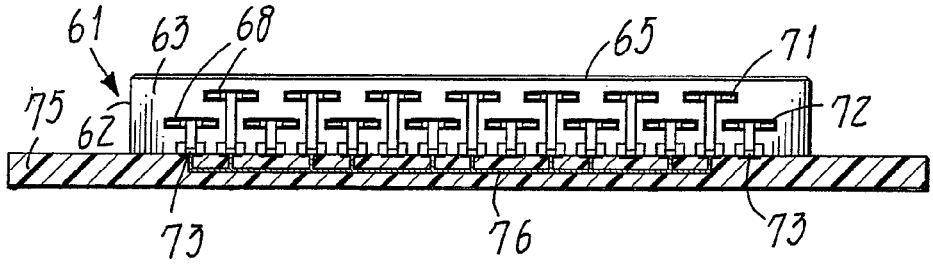
Fig. 24 Prior Art
FIG. 24 is a fragmentary and cross-sectional front elevation of the prior art connector.
Figure 25:
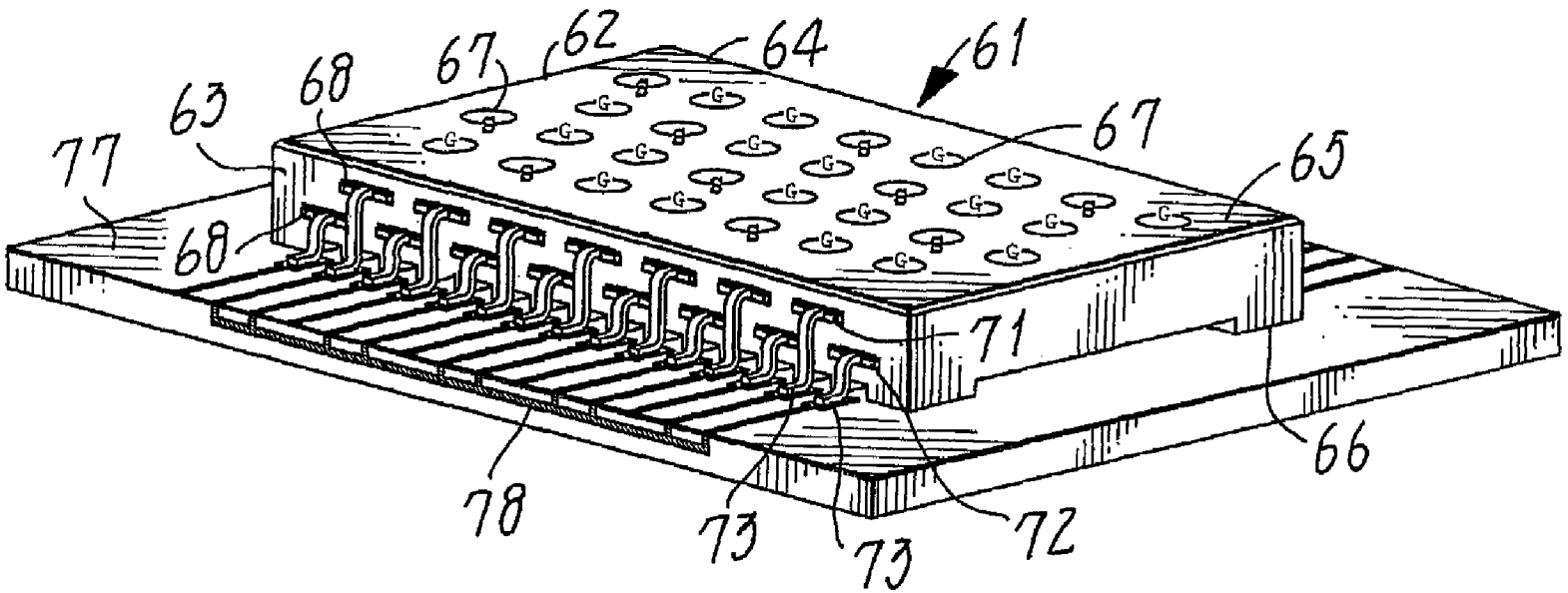
Fig. 25 Prior Art
FIG. 25 is a perspective view of the prior art connector that is surface mounted on another printed circuit board with a changed arrangement of signal connections 'S' and grounding connections 'G'.
Figure 26:
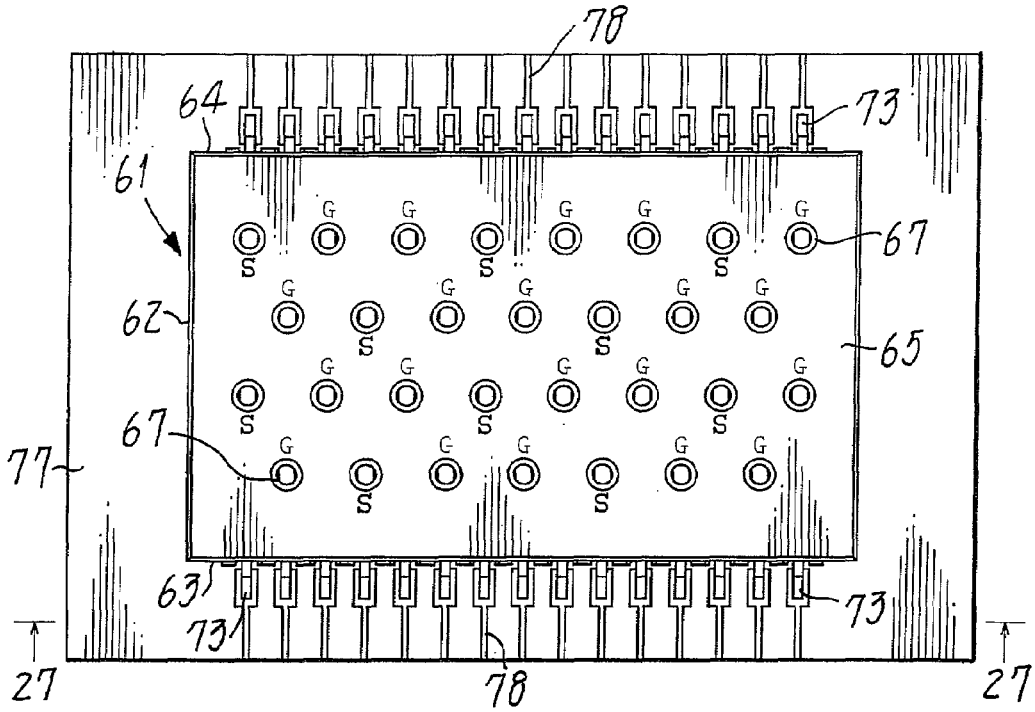
Fig. 26 Prior Art
FIG. 26 is a plan view of the prior art connectors shown in FIG. 25.
Figure 27:
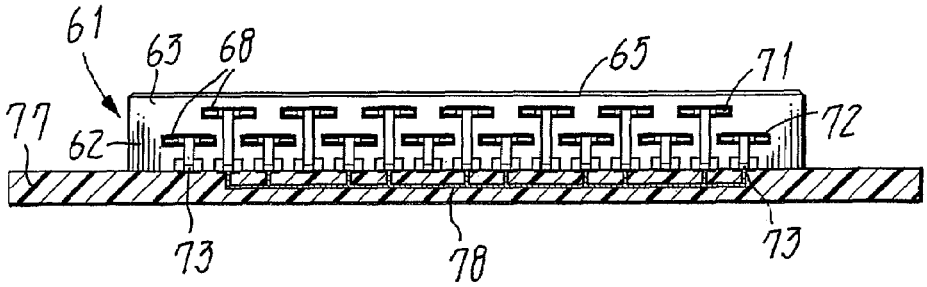
Fig. 27 Prior Art
FIG. 27 is a fragmentary and cross-sectional front elevation of the prior art connector as shown in FIG. 25.

The connector 1 serves to interconnect the two printed circuit boards 40 and 50. If and when any or some of the upper contacts 21 and lower contacts 22 all corresponding to the respective vertical holes 7 have to be changed from signal connections 'S' to grounding connections 'G', or vice versa, some short-circuit pins 30 will be placed in the canalled apertures 9 of housing 2. Due to such an operation as shown in FIGS. 18 and 19, the relevant and adjacent upper and lower contacts 21 and 22 will thus be combined with each other in a short-circuited manner. Each short-circuit pin 30 will be handled at its picking ear 34, when inserting it into one of the chosen canalled apertures 9. As seen particularly in FIG. 19(*b*), the inner lug 32 of the pin 30 will fit in the recess 10 so as to be retained in position. The pair of upper and lower resilient tongues 33 will press themselves to the upper and lower contacts 21 and 22, respectively due to their elastic force. Thus, connection between this pair of contacts alters from the previous signal connection to a new grounding connection. Further short-circuit pins 30 will likewise be fitted in all the other selected voluntary canalled apertures 9. Thus, the arrangement of signal connections 'S' and grounding connections 'G' will be changed in the circuit pattern on printed board 40 in any demanded fashion. In such an operation, every upper contact 21 short-circuited to the adjacent lower contact 22 will give a grounding connection 'G'. The other upper contacts 21 not short-circuited to any lower contacts 22 are left to maintain signal connections 'S'. The operation FIGS. 20 and 21 give examples of different arrangements of signal connections 'S' and grounding connections 'G' on the printed board 40, wherein those arrangements are effected by differently allocating the short-circuit pins 30.

It will now be apparent that the connector 1 of the invention enables it to easily change the arrangement of signal connections 'S' and grounding connections 'G' for any desired electronic circuit using this connector. Such a change is effected by merely removing the short-circuit pins 30 out of some canalled apertures 9 and by subsequently placing them 30 into the other canalled apertures 9, that are formed in the front and rear walls 3 and 4 of the connector housing 2. Now, the printed circuit boards need no longer be replaced with any alternative ones.

The invention claimed is:

1. A connector for establishing electric interconnection between printed circuit boards stacked vis-à-vis one on another and in parallel with each other, the connector comprising:

a depressed connector housing of a rectangular parallelepiped shape and having a front wall and a rear wall, a number of vertical holes pierced in and extending between a top and a bottom of the connector housing so as to penetrate it, the holes being for insertion of terminal pins, the front and rear walls respectively having horizontal slots pierced therein to receive contacts, each of the slots arranged to form an upper row and a lower row extending to intersect the corresponding one of the vertical holes at a right angle, each contact having a pin receiving portion that engages with the terminal pin inserted in the slot, each contact further having a body portion extending rearwards from the pin receiving portion, a rear end region of the body portion being bent down and then rearwards to form a lead portion, and one of the printed boards having a circuit pattern that is to be soldered to such lead portions of the contacts, such that the other printed circuit board mating with the one printed board has the terminal pins surface mounted to fit in the vertical holes, and the terminal pins from the mating printed board electrically engage with the pin receiving portions, wherein the connector further comprises short-circuit pins as well as canalled apertures that are formed in the front and rear walls and each in communication with the two adjacent slots, such that each short-circuit pin fitted in the chosen one of the canalled apertures is kept in touch with the two contacts held in the two adjacent slots, thereby establishing electrical engagement of one of the two contacts with the other so as to change arrangement of signal connections 'S' and grounding connections 'G' on one of the printed circuit boards.

2. A connector as defined in claim 1, wherein each canalled aperture for insertion of the short-circuit pin is a narrow vertical opening that has at its inner end a recess, each short-circuit pin made by the punching of a conductive metal plate has an end lug projected from a forward end of a body of the short-circuit pin, a pair of resilient tongues protrude rearwardly and sideways from upper and lower sides of the pin body, and a picking ear protrudes from a rearward end of said pin body, whereby with the short-circuit pin being put into the canalled aperture, the short-circuit pin having the end lug fitted in the recess is secured in position, while the pair of resilient tongues are forced into pressed touch with the two contacts held in the two adjacent slots, thus bringing the two contacts into mutual electric communication.

* * * * *